United States Patent [19]

McIntyre

[11] Patent Number: 4,795,080

[45] Date of Patent: Jan. 3, 1989

[54] PLASTIC EGG CARTON

[75] Inventor: David A. McIntyre, Bellwood, Canada

[73] Assignee: Cascades Dominion Inc., Brantford, Canada

[21] Appl. No.: 94,348

[22] Filed: Sep. 8, 1987

[51] Int. Cl.[4] ..... B65D 85/32

[52] U.S. Cl. ..... 229/2.5 EC; 206/521.1; 206/521.8

[58] Field of Search ..... 229/2.5 EC; 206/521.1, 206/521.8; 217/26.5

[56] References Cited

U.S. PATENT DOCUMENTS 4,088,259 5/1978 Sutton ..... 229/2.5 EC
4,480,781 11/1984 Emery et al. ..... 229/2.5 EC
4,609,141 9/1986 Lake ..... 229/2.5 EC

FOREIGN PATENT DOCUMENTS 665927 7/1963 Canada ..... 229/2.5 EC

*Primary Examiner*—Jimmy G. Foster
*Assistant Examiner*—Gary E. Elkins
*Attorney, Agent, or Firm*—Robert F. Delbridge; Arne I. Fors

[57] ABSTRACT

An egg carton of synthetic plastic material has a bottom portion and a cover portion positionable on the top of the bottom portion to close the carton. The bottom portion has a plurality of compartments each dimensioned to contain the bottom portion of an egg in spaced relationship to an adjacent egg, and the cover is dimensioned to receive the top portion of an egg when the egg is located in one of the compartments and the carton is closed. The compartments are shaped to cause eggs positioned therein to tilt with their longitudinal axes inclined to the vertical by an angle in the range of from about 4 to about 6 degrees.

6 Claims, 4 Drawing Sheets

14
61
63
56
62
64
3
54
6
61
26
28
26
28
52
3
6
12

54
62
56
14
52
64
64
26
24
58
18
42
32
60
34
20
22
16
36
36
40
40
46
46
38
30
12
30
48
50
50
48

PLASTIC EGG CARTON

This invention relates to egg cartons moulded from synthetic plastic material.

Egg cartons, which are usually designed to contain twelve eggs, are conventionally made either of moulded pulp or of synthetic plastic material such as foamed polystyrene. Plastic egg cartons are generally acknowledged to have a better appearance, but suffer from the disadvantage that a plastic egg carton has to have approximately twice the wall thickness as an egg carton of moulded pulp to achieve the same structural strength. However, commercial considerations require that an egg carton have standard external dimensions. The necessary increased wall thickness of a plastic egg carton therefore reduces the egg containing space available inside the carton. This problem becomes significant when a plastic egg carton is used to contain large or extra large eggs. Such eggs may become jammed between the cover and the bottom portion of the egg carton, and hence become very susceptible to breakage, especially when weight is placed on the lid as happens when cartons are stacked on top of each other.

It is therefore an object of the present invention to provide a plastic egg carton which can be constructed with conventional external dimensions and yet in which the likelihood of egg breakage when the carton is used to contain large or extra large eggs is reduced.

According to the present invention, an egg carton of synthetic plastic material comprises a bottom portion and a cover portion positionable over the top of the bottom portion to close the carton, the bottom portion having a plurality of compartments each dimensioned to contain the bottom portion of an egg in spaced relationship to an adjacent egg, and the cover being dimensioned to receive the top portion of an egg when the egg is located in one of the compartments and the carton is closed, the compartments being shaped to cause eggs positioned therein to tilt with their longitudinal axes inclined to the vertical by an angle in the range of from about 4 to about 6 degrees.

The present invention enables a plastic egg carton to be provided which can satisfactorily accommodate a wide size range of eggs, including large and extra large eggs, while maintaining the same external dimensions as conventional cartons without reducing wall thickness, structural strength or protective qualities of the carton.

The bottom portion of the carton may have two side-by-side rows of compartments, with each compartment being shaped to cause eggs positioned therein to tilt in an upward direction away from a corresponding egg in an adjacent row with an inclination to the vertical in the range of from about 4 to about 6 degrees.

Each carton may have a bottom surface shaped to guide the lower end of an egg in the compartment to a position to incline the egg at said angle of inclination. The bottom surface of each compartment may have an upstanding annulus positioned to effect said guiding of the upper end of an egg.

The bottom portion may have a series of longitudinally-spaced integral upstanding rectangular posts, each post having side walls which each form an egg-supporting surface of a different adjacent compartment, each compartment other than a compartment at the end of a row comprising a side wall of each of two adjacent posts, with each compartment also having egg supporting side wall portions opposite said post side walls, the side walls of the posts and the opposite side wall portions of each compartment being inclined to position an inserted egg in said inclination to the vertical between about 4 and about 6 degrees.

The cover portion may have longitudinal-spaced integral downwardly-extending posts which engage the upstanding posts of the bottom portion when the carton is closed. The cover portion may also have apertures between the downwardly-extending posts to enable eggs within the carton to be visible. The downwardly-extending posts of the cover portion and the upstanding posts of the bottom portion may have ends shaped to interengage when the carron is closed.

Embodiments of the invention will now be described, by way of example, with reference to the accompanying drawings, of which:

Figure 1:
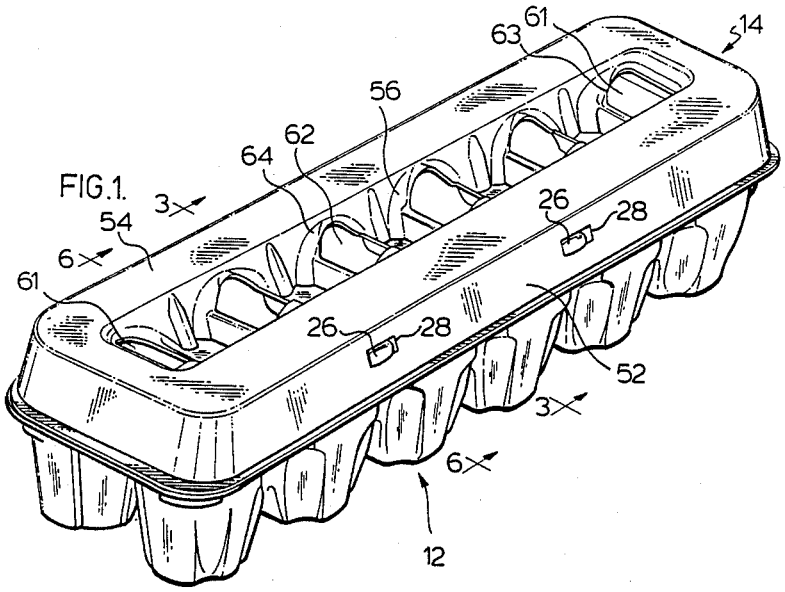
FIG. 1 is a perspective view of an egg carton in a closed condition.
Figure 3:
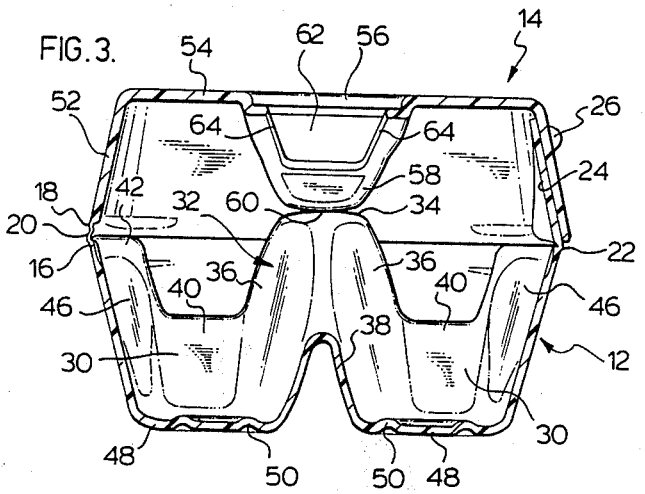
FIG. 3 is a sectional view taken along the line 3—3 of FIG. 1.
Figure 2:
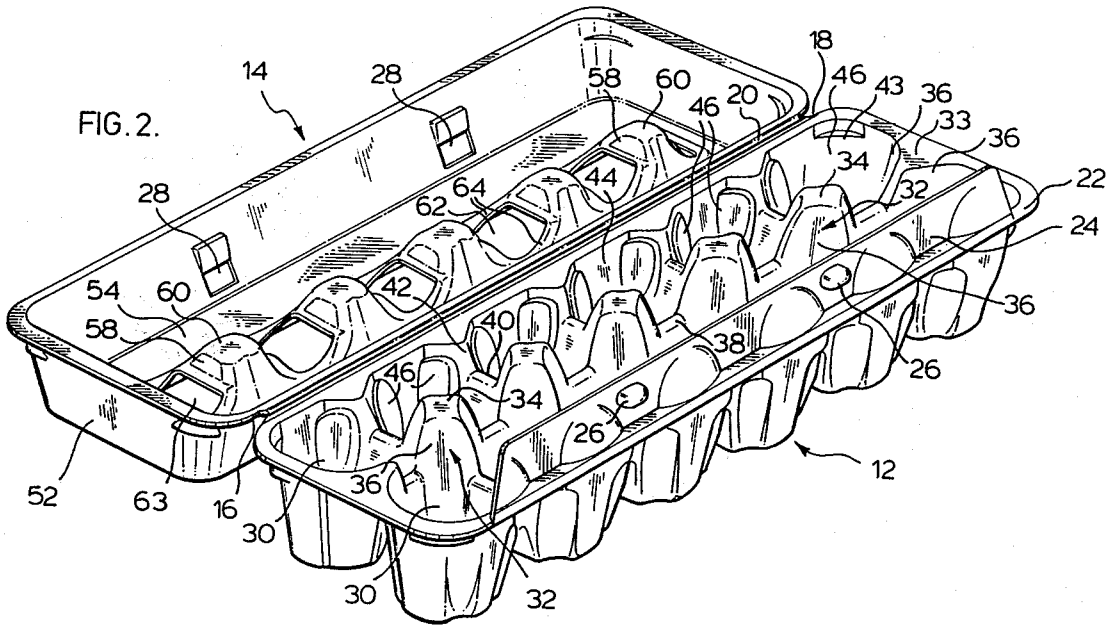
FIG. 2 is a similar view showing the carton in an open position.
Figure 3A:
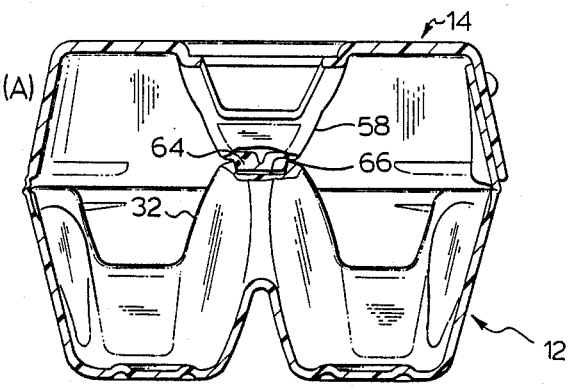
Figure 4:
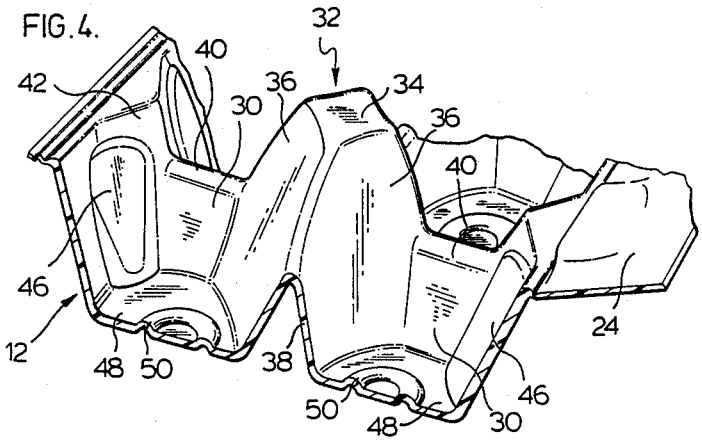
Figure 5:
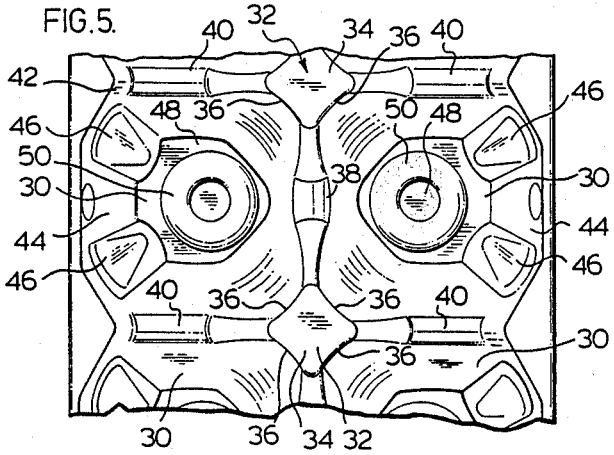
Figure 6:
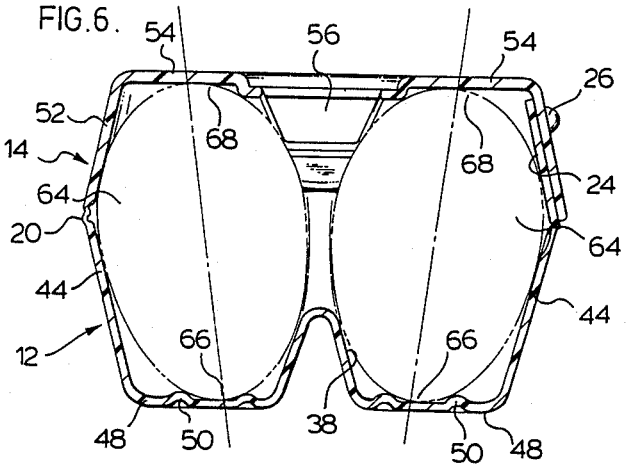
Figure 7:
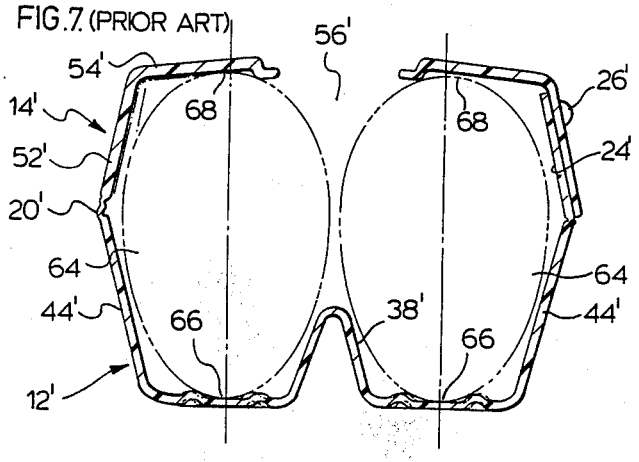
FIG. 7. (PRIOR ART)

FIG. 3A is a similar view but showing a further embodiment in which the down posts interengage when the carton is closed, FIG. 4 is a fragmentary perspective view of the bottom portion of the carton, FIG. 5 is a fragmentary plan view of the bottom portion of the carton, FIG. 6 is a sectional view along the line 6—6 of FIG. 1 showing the angular inclination of eggs in adjacent rows, and FIG. 7 is a similar view but showing the prior art.

Referring to the drawings, an egg carton is formed as an integral moulding of synthetic plastic material, for example foamed polystyrene. The egg carton has an elongated bottom portion 12 which is rectangular in plan view, and a cover 14 integrally connected thereto along adjacent longitudinal side edges 16, 18 respectively by hinge portion 20. An opposed side edge 22 of the bottom portion 12 has an integral longitudinally-extending flap 24 which carries two longitudinally-spaced outwardly-facing projections 26, which engage in correspondingly spaced apertures 28 in the cover 14 to retain the cover 14 in the closed position.

The bottom portion 12 has two longitudinally-extending side-by-side rows of egg-receiving compartments 30, there being six compartments 30 in each row so that the carton will hold a total of twelve eggs. A series of longitudinally-spaced upstanding posts 32 extends along the centre line of the bottom portion 12, each post 32 being upwardly-tapering and rectangular in plan view to terminate with an upper face 34. Each post 32 is oriented such that the four side faces 36 of the post are at an angle of 45 degrees to the longitudinal axis of the bottom portion 12. An interconnecting wall 38 extends longitudinally between each adjacent pair of posts 32, and an interconnecting wall 40 extends transversely between each post 32 and an inwardly projecting portion 42 of the side wall 44 of each compartment 30.

Each inwardly-projecting side wall portion 42 has a pair of slightly upwardly and outwardly inclined and inwardly projecting egg-supporting side wall portion 46, such that each compartment 30 has a pair of egg-supporting side wall portions 46 and a pair of egg-supporting post side faces 36 which function to laterally support an egg as will be explained in more detail later.

Each compartment 30 also has a bottom wall 48 with a slightly raised annular guide portion 50 which is offset from the centre of the compartment towards the central longitudinally axis of the bottom portion 12, as also will be explained in more detail later.

The cover 14 is also rectangular in plan view in the same manner as the bottom portion 12, and has a peripherally continuous upwardly and inwardly inclined side wall 52 and a flat top wall 54 with a longitudinally-extending central recessed portion 56. The recessed portion 56 is shaped to provide downwardly-extending posts 58 with bottom surfaces 60 which, when the cover 14 is closed, engage the top surfaces 34 of upstanding posts 32 in the bottom portion 12. The recessed portion 56 has apertures 62 between the down posts 56, the apertures 62 having hooded side walls 64 for a purpose which also will be described in more detail later.

The end compartments 30 are similar to the other compartments 30 except that, at the ends of the bottom portion 12, up post side faces 36 are formed as partial up posts 33, and egg-supporting surfaces 46 are formed as partial projections 43. Similar comments apply to the cover 14, wherein a smaller aperture 63 is provided between each end down post 58 and the adjacent end portion of side wall 52.

In use, eggs 64 are placed in the compartments 30 with their pointed ends 66 downwardly, i.e. with their blunt ends 68 uppermost. The egg-supporting surfaces 46 and the egg-supporting up posts side faces 36 are dimensioned, in conjunction with the off-centre position of the annular bottom guide 50 to cause eggs 64 in the compartments 30 to be oriented so that they are inclined upwardly and laterally outwardly away from the vertical with an angle of about 5 degrees, as shown in FIG. 6.

When the cover 14 is closed, large or extra large eggs 64 fit comfortably within a carton of otherwise standard dimensions. FIG. 7 illustrates what happens with prior art cartons when large or extra large eggs are contained therein the standard orientation. In FIG. 7, parts equivalent to those in the described embodiment are shown with primed reference numerals. As shown, the blunt ends 68 of the eggs 64 engage the cover 14' of the prior art carton and bulge the cover 14' upwardly, thereby rendering egg breakage likely when weight is placed on the cover 14', for example by other cartons stacked thereon. FIG. 6 shows how such eggs are accommodated in a carton in accordance with the present invention, thereby reducing the likelihood of breakage. Further, with the carton in accordance with the invention, the lateral inclination of the egg 64 produces a better utilization of the relative angularity of the top 54 and side wall 52 of the cover 14 compared to the prior art.

The above-described preferred embodiment of the invention was produced by redesigning a conventional egg carton, namely by appropriate shaping of the egg-supporting side surfaces 46 and the egg-supporting up posts side faces 36, and by shifting of the annular guide 50 from a central position in the compartment laterally towards the longitudinal axis of the carton, without it being necessary to make any change to the design of the cover 14.

The apertures 61, 62 in the cover 14 enable eggs in the carton to be clearly visible to an intending purchaser, and the hooded side walls 64 of the apertures provide further protection for the top portions of the eggs. If desired, the bottom of the down posts 58 of the cover 14 and the tops of the up posts 32 of the bottom portion 12 may be provided with integrating projections 64 and recesses 66 respectively, as shown in FIG. 3A, so as to further strengthen the closed carton.

Other embodiments of the invention will be readily apparent to a person skilled in the art, the scope of the invention being defined in the appended claims.

I claim:

1. An egg carton of synthetic plastic material comprising a bottom portion and cover portion positionable on the top of the bottom portion to close the carton, the bottom portion having two side-by-side rows of compartments each dimensioned to contain the bottom portion of an egg in spaced relationship to an adjacent egg, and the cover being dimensioned to receive the top portion of an egg when the egg is located in one of the compartments and the carton is closed, and the bottom portion having a series of longitudinally-shaped integral upstanding rectangular posts, each post having side walls which form egg-support surfaces of different adjacent compartments, each compartment other than a compartment at the end of the row comprising a side wall of each of two adjacent posts, and each compartment also having egg-supporting side wall portions opposite said post side walls, the side walls of the posts and the opposite side wall portions of each compartment being inclined to cause an an egg positioned therein to tilt in an upward direction away from a corresponding egg in an adjacent row with an inclination to the vertical in the range of from about 4 and about 6 degrees.

2. An egg carton according to claim 1 wherein each compartment has a bottom surface shaped to guide a lower end of an egg in the compartment to a position to incline the egg at said angle of inclination.

3. An egg carton according to claim 2 wherein said bottom surface of each compartment has an upstanding annulus positioned to effect said guiding of the lower end of the egg.

4. An egg carton according to claim 1 wherein the cover portion has longitudinally spaced integral downwardly extending posts which engage the upstanding posts of the bottom portion when the carton is closed.

5. A carton according to claim 4 wherein the cover portion has apertures between said downwardly extending posts to enable eggs inside the carton to be visible.

6. An egg carton according to claim 4 wherein the downwardly extending posts of the cover and the upwardly extending posts of the bottom portion have ends shaped to interengage when the carton is closed.

* * * * *